United States Patent [19]

Aoyama et al.

[11] 4,351,492

[45] Sep. 28, 1982

[54] METHOD FOR THREADING A YARN DELIVERED FROM A GODET ROLLER ON A BOBBIN AND AN APPARATUS FOR EFFECTING THE SAME

[75] Inventors: Hideki Aoyama; Takashi Kishida, both of Matsuyama, Japan

[73] Assignee: Teijin Limited, Ehime, Japan

[21] Appl. No.: 90,593

[22] Filed: Nov. 2, 1979

[30] Foreign Application Priority Data

Nov. 7, 1978 [JP] Japan ..... 53/152314[U]

[51] Int. Cl.[3] ..... B65H 54/02

[52] U.S. Cl. ..... 242/18 R; 242/18 DD; 242/18 PW; 242/47.01; 226/91; 226/193

[58] Field of Search ..... 242/18 DD, 18 PW, 18 R, 242/18 A, 35.5 R, 45, 47.01, 47.03, 47.08, 47.09, 47.11, 47.12, 47.13; 226/168, 190, 193, 91; 425/66, 67, 68, 71; 28/240–246

[56] References Cited

U.S. PATENT DOCUMENTS

| | | | |
|---|---|---|---|
| 2,788,256 | 4/1957 | Allen | 242/47.11 X |
| 3,323,191 | 6/1967 | Davies | 226/91 |
| 3,561,045 | 2/1971 | Heffernan | 242/47.09 X |
| 3,831,873 | 8/1974 | Bense | 242/47.01 X |
| 3,964,723 | 6/1976 | Schippers et al. | 242/18 DD X |
| 4,033,519 | 7/1977 | Abe et al. | 242/18 A |

FOREIGN PATENT DOCUMENTS

| | | | |
|---|---|---|---|
| 18563 | 9/1967 | Japan | 242/47.01 |

*Primary Examiner*—Stanley N. Gilreath
*Attorney, Agent, or Firm*—Burgess, Ryan and Wayne

[57] ABSTRACT

Polyester yarns spun from spinnerets are delivered to bobbins held on a bobbin holder in a winding apparatus through godet rollers which have mirror finished surfaces and axially grooved surfaces. Upon threading the yarns on the bobbins, the yarns are moved to the axially grooved surface from the mirror finished surfaces by means of a yarn displacing guide disposed upstream of the uppermost godet roller. The change in the tension in the yarn caused by the threading operation of the yarn is transmitted beyond the godet rollers, and entanglement of the yarn around the godet roller does not occur.

13 Claims, 11 Drawing Figures

METHOD FOR THREADING A YARN DELIVERED FROM A GODET ROLLER ON A BOBBIN AND AN APPARATUS FOR EFFECTING THE SAME

TECHNICAL FIELD TO WHICH THE INVENTION RELATES

The present invention relates to a method and apparatus by which a yarn delivered from a godet roller can be effectively threaded on an empty bobbin rotatably supported on a winding apparatus and rotated at a high speed without causing the entanglement of the yarn around the godet roller and the degradation of wound yarn. More specifically, the present invention relates to a method and apparatus by which one or more synthetic yarns spun from a spinneret can be effectively threaded on empty rotating bobbins rotatably supported on a winding apparatus without causing the entanglement of the yarn around the godet roller disposed upstream of the winding apparatus and without causing the degradation of the yarn positioned at the innermost portion in the yarn package.

BACKGROUND OF THE INVENTION

Recently in the fiber industry, especially the synthetic fiber industry, the yarn treating speed has been increased very much, and it is usual that the treating speed of a synthetic multifilament yarn is equal to or more than 2500 m/min. When a yarn is treated at such a high speed, a certain operation which has conventionally been effected on a yarn without causing any trouble at a relatively low speed, cannot be carried out during a high speed winding operation. For example, it is very difficult to thread a yarn, which is delivered at a speed equal to or higher than 2500 m/min from a godet roller on a bobbin rotatably supported on a winding apparatus without causing any entanglement of the yarn around the godet roller. The reason will be explained hereinbelow. To obtain a package having a good shape by winding a yarn delivered at a high speed on a bobbin, it is very important that the winding angle, contacting pressure between the bobbin and friction roller, and the tension in the delivered yarn are properly adjusted, and it is well known that the tension in the yarn wound on a bobbin has an influence upon the shape of the obtained yarn package. Accordingly, to obtain a good wound package shape, it is required that a yarn is wound on a bobbin at a tension in the yarn as low as possible. However, when a yarn delivered at a low tension is threaded on a bobbin, there is a tendency that trouble occurs wherein the threading of the yarn fails frequently, because the yarn slack takes place temporarily at a portion between the lowermost godet roller and the winding apparatus, and as a result, the yarn entangles around the godet roller.

To obviate the above-mentioned trouble, the inventors of the present invention effected careful research regarding the mechanism of the entanglement of the yarn around the godet roller. They have found that the trouble does not occur if the temporarily lowered tension in the yarn upon threading is transmitted beyond the godet roller to upstream of the godet roller. However, it should be noted that the godet roller has a function in that it delivers a yarn at a constant speed while the yarn is normally being wound.

SUMMARY OF THE INVENTION

An object of the present invention is to provide a method for threading a yarn delivered at a high speed from a godet roller on a bobbin rotatably supported on a winding apparatus without causing entanglement of the yarn around the godet roller.

According to the present invention, the object is achieved by a method which comprises:

delivering a yarn on a yarn threading zone of a godet roller, in which zone the yarn is permitted to slip in a first direction along which the yarn is delivered when the tension in the yarn exceeds a certain tension, while the yarn does not substantially slip in a second direction perpendicular to the first direction axially along the godet roller;

engaging the yarn delivered from the yarn threading zone with a bobbin which is rotating at a high speed so that the yarn is caught by the bobbin; and returning the yarn on the godet roller from the yarn threading zone to a normal yarn delivering zone, wherein the yarn does not substantially slip in the first and second direction.

The method according to the present invention can be carried out with a winding apparatus wherein a yarn is manually threaded on a bobbin by utilizing a yarn take up means, such as a suction gun, and with another winding apparatus wherein a turret having a plurality of bobbin holders disposed thereon is turned upon the change of the bobbins and wherein a yarn is automatically threaded on a bobbin.

In another aspect of the present invention, a method for threading a synthetic yarn on a bobbin is carried out in a spinning and winding process, wherein one or more synthetic yarns are spun from spinnerets and are partially orientated. In this aspect of the invention, the yarn or yarns are engaged with the bobbin or bobbins after the peripheral speed of the rotating bobbin exceeds a predetermined speed.

A still further object of the present invention is to provide an apparatus for threading a yarn on a bobbin without causing the entanglement of the yarn around a godet roller. The object of the present invention is achieved by an apparatus comprising:

a godet roller for delivering a yarn to a bobbin, which roller is provided with: a yarn threading zone wherein the yarn is permitted to slip in a first direction along which the yarn is delivered when the tension in the yarn exceeds a certain tension, while the yarn does not substantially slip in a second direction perpendicular to the first direction; and a normal yarn delivering zone wherein the yarn does not substantially slip in the first and second directions;

a yarn displacing guide which is disposed upstream of the godet roller movable parallel to the axis of the godet roller so that the yarn passage on the godet roller is displaced between the normal yarn delivering zone and the yarn threading zone; and a winder having a rotatable bobbin holder on which the bobbin is inserted and which is disposed downstream of the godet roller.

In an embodiment of the present invention, the godet roller is provided with:

a substantially mirror finished surface which serves as the normal yarn delivering zone; and an axially grooved surface which is formed adjacent to the mirror finished surface and formed with many grooves extending axially along the godet roller and which serves as the yarn threading zone.

BRIEF DESCRIPTION OF THE DRAWINGS

Some embodiments of the present invention will be explained hereinbelow with reference to the accompanying drawings wherein.

DETAILED DESCRIPTION OF THE INVENTION

Figure 1:
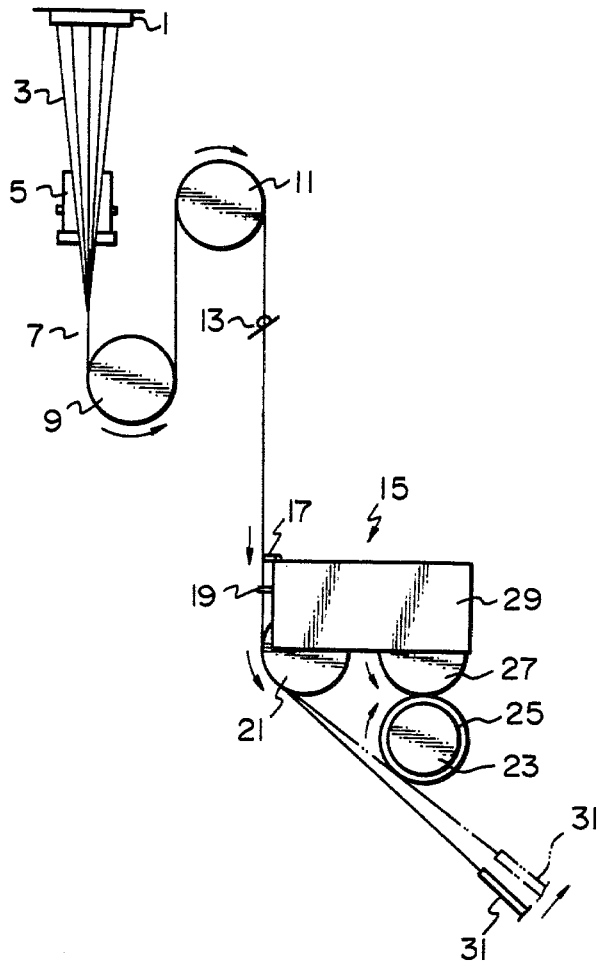
FIGS. 1 and 2 are elevational views which are used to explain the principle of the present invention.
Figure 2:
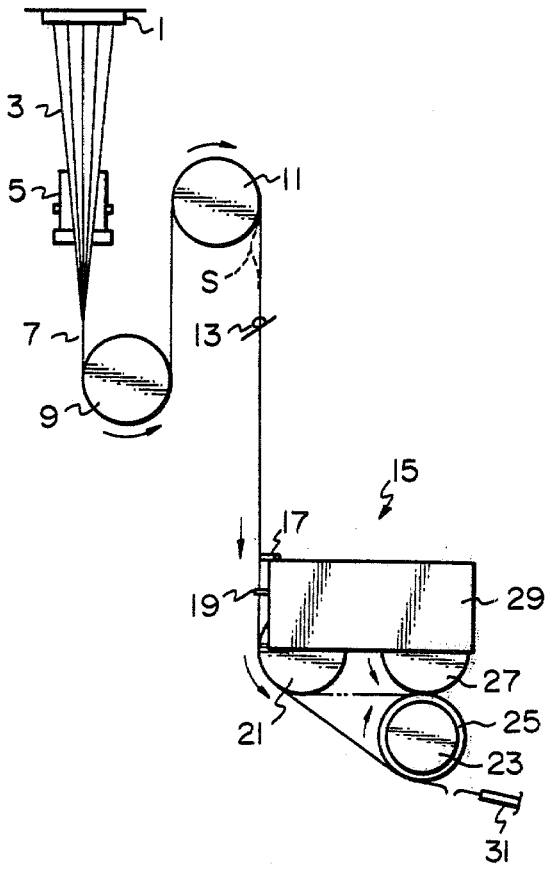

In FIGS. 1 and 2, filaments 3 of a synthetic material, such as a polyester, are spun from a spinneret 1 and are gathered together to form a yarn 7 after they are subjected to a finishing operation by means of an oiling roller 5. The yarn 7 is cooled in a cooling duct (not shown), and then it is partially orientated and delivered at a constant speed, for example 3500 m/min, by means of a first godet roller 9 and a second godet roller 11 to a winding apparatus 15 via a yarn guide 13.

A typical winding apparatus 15 is illustrated in FIGS. 1 and 2 and comprises: a traverse guide 19 for traversing the yarn 7 in a direction substantially perpendicular to the yarn passage from the second godet roller 11; a grooved roller 21, disposed downstream of the traverse guide 19, for assisting the traverse motion of the yarn 7; a rotatable bobbin holder 23 for holding a bobbin 25 on which the yarn 7 is wound to form a yarn package; and a friction roller 27 for frictionally engaging with the bobbin 25 held on the bobbin holder so as to rotate the bobbin 25 at a high speed. The traverse guide 19, the grooved roller 21 and the friction roller 27 are mounted on a carrier 29 which is vertically movable. The carrier 29 is further provided with a yarn disengaging guide 17 which is swingable so as to disengage the yarn 7 from the traverse guide 19 while the yarn 7 is being threaded on the bobbin 25.

When the yarn 7 is being threaded on the bobbin 25 held on the bobbin holder 23, the yarn 7 is taken up by means of a take up means, such as a suction gun 31, and is led along a yarn passage through the yarn disengaging guide 17 and the grooved roller 21 as illustrated with a solid line in FIG. 1. Then, the suction gun 31 is moved upwards slowly so that the yarn 7 illustrated with a two dot-dash line in FIG. 1 contacts with the bobbin 25, and accordingly, the yarn 7 is caught by groove (not shown) formed on the peripheral surface of the bobbin 25 or a yarn engaging finger (not shown) attached to the side of the bobbin 25. The yarn between the bobbin 25 and the suction gun 31 is cut because of the increased tension. The caught yarn end rotates as the bobbin 25 is rotated by the friction roller 27, and the yarn between the grooved roller 21 and the bobbin 25 slacks temporarily. The slack of the yarn 7 runs back upwards along the yarn 7 towards the second roller 11 as illustrated with a broken line S in FIG. 2. It should be noted that in a conventional apparatus, since the godet roller does not permit the yarn to slip thereon along its delivering direction, the yarn 7 entangles around the godet roller 11 because of the slacked yarn illustrated with the broken line S in FIG. 2.

According to the present invention, the godet roller 11 is specially designed so that, while the yarn is threaded on the bobbin, the godet roller permits the yarn to slip in a first direction along which the yarn is delivered, but it does not permit the yarn to substantially slip in a second direction perpendicular to the first direction axially along the roller. When the yarn is normally delivered, it is preferable that the godet roller 11 does not permit substantial slippage in the first and second directions so that the yarn is delivered at a constant speed without causing yarn speed fluctuation.

Figure 3:
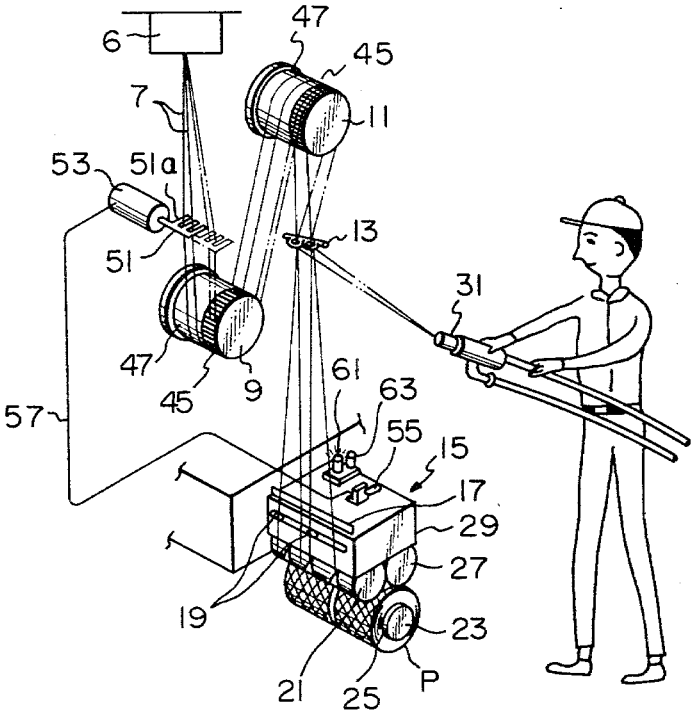
FIGS. 3 and 4 are perspective views of an embodiment of the present invention.
Figure 4:
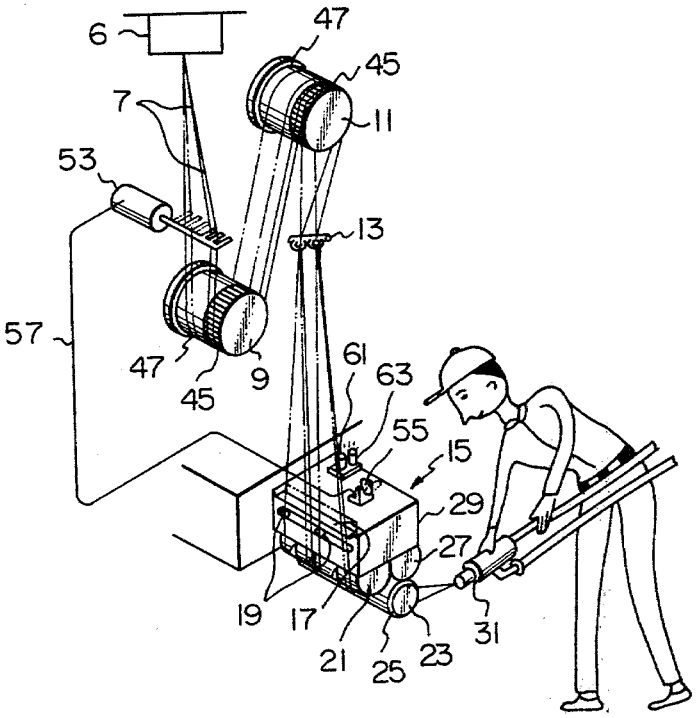

A first embodiment of the present invention is illustrated in FIGS. 3 and 4. In FIG. 3, two yarns 7, each of which is composed of a plurality of synthetic filaments spun from spinnerets (not shown), are cooled in a cooling duct 6, and then, are delivered by the first and second godet rollers 9 and 11 to a winding apparatus 15 via yarn guides 13. The construction of the winding apparatus is the same as that of the winding apparatus illustrated in FIG. 1 except that the bobbin holder 23 is adapted to hold a pair of bobbins 25.

Figure 5:
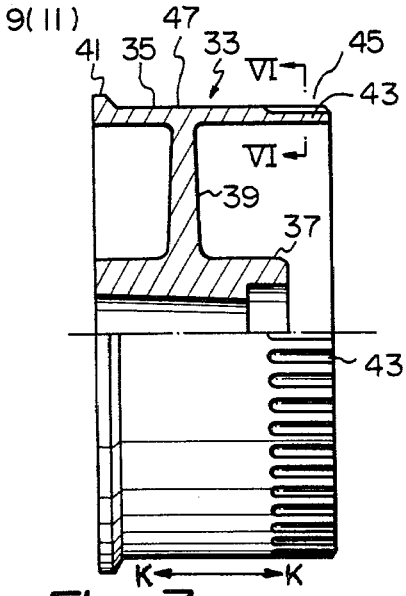
FIG. 5 is a partial cross sectional side view of the roller utilized in the embodiment illustrated in FIGS. 3 and 4.
Figure 6:
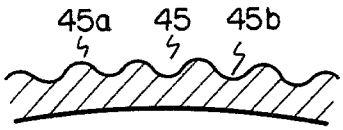
FIG. 6 is a cross sectional view taken along line VI—VI in FIG. 5.

The detailed construction of the first or second godet roller 9 or 11 will be explained hereinbelow with reference to FIG. 5. The body portion 33 of the godet roller 9 or 11 comprises a roller shell 35, a boss 37 which is fastened to a drive shaft (not shown) and a reinforcing ring 39 for connecting the roller shell 35 to the boss 37. The rear end of the roller shell 35 is provided with an annular flange 41. The front peripheral surface of the roller shell 35 has many shallow and narrow grooves 43 which extend along the axis of the godet roller 9 or 11 and which are equidistantly formed on the periphery of the roller shell 35. The front peripheral surface which has a plurality of grooves 43 forms a yarn threading zone 45 of the present invention. The peripheral surface located adjacent to the yarn threading zone 45 has a smooth surface similar to that of the conventional godet roller obtained by mirror finishing, satin finishing or combined finishing, and it serves as a normal yarn delivering zone 47. The yarn threading zone 45 is formed into smooth and parallel ridges **45*a* and grooves 45*b* or corrugated as illustrated in FIG. 6. and is plated by hard chromium so that the yarn is not damaged when it is in contact with the imaginary peripheral locus which encircles the outermost portion of the yarn threading zone 45. In the embodiment illustrated in FIG. 5, the yarn threading zone 45 is formed at the front end region of the godet roller 9 or 11. However, the yarn threading zone 45 may be formed at will at the rear end or the central portion of the godet roller 9 or 11** in accordance with the yarn winding and threading conditions. When grooves are formed at the front end of the godet roller, it is preferable that a smooth surface (not shown) having a width of several millimeters is formed at the front end of the godet roller. The smooth surface located at the front end of the godet roller is utilized to manually stop the rotation of the godet roller by pressing the hand on the surface without injuring the hand of the operator when the yarn entangles around the godet roller. The arrow K ⟷K shown in FIG. 5 illustrates the second direction in which the yarn does not substantially slip.

Figure 8:
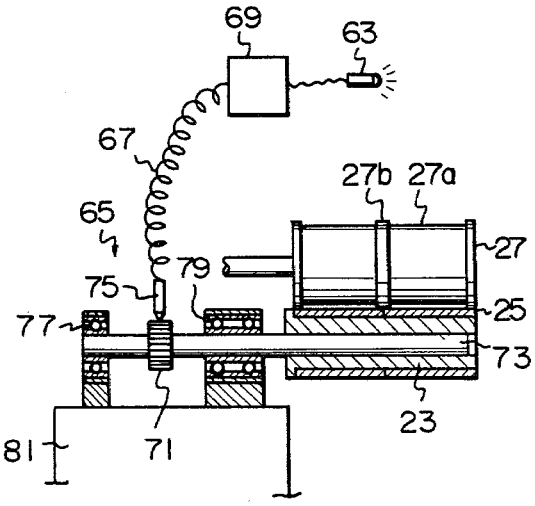
FIG. 8 is a diagrammatical cross sectional side view of the bobbin holder utilized in the embodiment illustrated in FIGS. 3 and 4.

Referring to FIG. 3 again, a comb guide 51 having three pins 51*a* extending transversely is disposed just above the first godet roller 9 and is moved along the axis of the godet roller 9 by means of a pneumatic actuator 53. The pneumatic actuator 53 is communicated via an air pipe 57 with a mechanical valve 55 which is disposed on the carrier 29 of the winding apparatus 15 and which is manually operable. An indicator lamp 61 disposed on the carrier 29 is lit when the package P formed on the bobbin 25 reaches a predetermined amount. Another indicator lamp 63 also disposed on the carrier 29 indicates that the peripheral speed of the bobbin 25 held on the bobbin holder 23 is in a predetermined range. The indicator lamp 63 is, as illustrated in FIG. 8, electrically connected to a speed detector 65 via a cord 67 and a control circuit 69. The speed detector 65 comprises a gear wheel 71 which is made of steel and which is securely fixed to a shaft 73 of the bobbin holder 23 and an electromagnetic pickup 75 which is disposed adjacent to the gear wheel. When the detected pulses emitted from the electromagnetic pickup 75 are introduced through the cord 67 into the control circuit 69, they are compared with the standard pulses which can be adjusted in accordance with the spinning conditions. If the number of the detected pulses within a predetermined observing time period is larger than that of the standard pulses, the indicator lamp 63 is lit. The shaft 73 of the bobbin holder 23 is rotatably supported by bearings 77 and 79 mounted on a machine frame 81 of the winding apparatus 15.

Referring to FIG. 3 again, the comb guide 51 is retracted by the pneumatic actuator 53 as illustrated with a solid line, and the yarns 7 spun from the spinnerets (not shown) through the cooling duct 6 are delivered through the first and second godet rollers 9 and 11 and the yarn guides 13 to the winding apparatus 15 where the yarns 7 are wound on the bobbins 25 to form the packages P. When the amount of the packages P reaches a predetermined amount, the indicator lamp 61 is lit, and then the operator operates the mechanical valve 55 so that the comb guide 51 is advanced by means of the pneumatic actuator 53 as illustrated with a two dot-dash line. As a result, the yarns 7 are moved along the axis of the godet rollers 9 and 11; in other words they are displaced from the normal yarn delivering zone 47 to the yarn threading zone 45. Then the yarns 7 are sucked together by the suction gun 31, which is of a conventionally known type, downstream of the yarn guide 13. After the winding apparatus 15 is stopped, the full bobbin 25 having a package P completely wound thereon is doffed from the bobbin holder 23, and then a new empty bobbin 25 is donned onto the bobbin holder 23. The winding apparatus 15 is started again, and when the peripheral speed of the empty bobbin reaches the predetermined speed, the indicator lamp 63 is lit. After the indicator lamp 63 is lit, in other words after the peripheral speed of the empty bobbin 25 exceeds the predetermined minimum speed, the operator leads the yarns 7 by moving the suction gun 31 outside the winding apparatus 15 as illustrated with the solid line in FIG. 4. As the yarns 7 delivered from the grooved roller 21 to the suction gun 31 are moved upwards, the yarns are engaged with grooves (not shown) formed on the surfaces of the bobbins 25, and then the yarns 7 are temporarily slacked, and the slack runs back towards the second godet roller 11 along the yarns 7 as explained with reference to FIGS. 1 and 2. Even if the slack in the yarns 7 reaches the second godet roller 11, the slack, in other words the changes in the tensions in the yarns, passes by the second godet roller 11 because the yarn threading zone 45 on which the yarns are delivered is specially constructed, and therefore the yarns 7 do not entangle around the godet roller 11. The slack in the yarns between the first and second godet rollers, which slack has been decreased by passing by the second godet roller 11, runs back in the yarns 7 again towards the first godet roller 9 and passes by the godet roller 9 because the yarn threading zone 45 on which the yarns 7 are delivered is also specially constructed, and as a result, the yarns 7 do not entangle around the first godet roller 9. The slack in the yarn between the cooling duct 6 and the first godet roller 9 is absorbed in the yarns. After the yarns 7 are threaded on the bobbins 25 held on the bobbin holder 23, the yarn disengaging guide 17 is returned and then the yarns 7 are caught by the traverse guides 19. The pneumatic actuator 53 is retracted by switching the mechanical valve 55 so that the yarns 7 are returned, as illustrated with a two dot-dash lines in FIG. 4, along the axis of the first and second godet rollers 9 and 11 to the normal yarn delivering zones.

The design of the godet roller 9 or 11 will now be explained with reference to FIG. 5. The size of the grooves 43 formed in the yarn threading zone 45 of the godet roller 9 or 11 can be slightly changed in accordance with the material of the yarn to be delivered on the groove and the diameter of the godet roller; however, it is preferable that the depth of the grooves is between 0.5 mm and 5 mm and that the pitch angle of the groove is between 1 deg and 6 deg.

It is preferable that the grooves 43 formed in the yarn threading zone 45 extend in a direction parallel to the axis of the godet roller 9 or 11. However, in some cases, the grooves 43 may be inclined at a certain angle, for example an angle between 45 deg and 60 deg, against the axis of the godet roller 9 or 11, or alternatively the yarn may be delivered obliquely to the grooves 43 of the godet roller 9 or 11.

Figure 7:
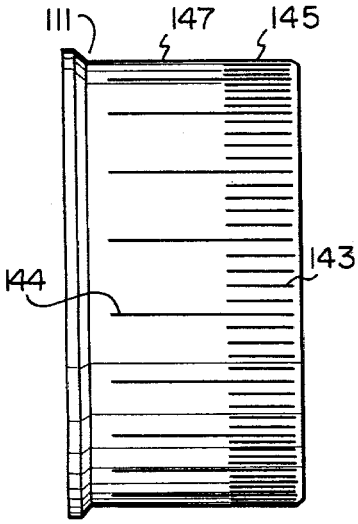
FIG. 7 is a side view of another roller.

Instead of the godet roller 9 or 11 illustrated in FIG. 5, a godet roller 111 which is illustrated in FIG. 7 and which comprises a yarn threading zone 145 and a normal yarn delivering zone 147 can be used. The construction of the yarn threading zone 145 is similar to that of the yarn threading zone 45 in the godet roller 9 or 11 illustrated in FIG. 5. In the normal yarn delivering zone 147, there are narrow and shallow grooves 144, and the number of these grooves 144 is remarkably smaller than that of grooves 143 formed on the yarn threading zone 145, said grooves 144 are formed in a direction parallel to the grooves 143. The godet roller 111 can deliver the yarn at a considerably low tension in the yarn, and it is preferable that such a godet roller is utilized for obtaining a package having a good shape under high speed winding conditions. It is preferable that the depth of the grooves 144 is between 0.5 mm and 5 mm and that the pitch angle of the grooves 144 is between 20 deg and 60 deg.

The inventors of the present invention observed the changes in the tension in the yarns downstream of the second godet roller 11, between the first and second godet rollers 9 and 11, and upstream of the first godet roller 9 when the yarn was threaded on the bobbin, and they confirmed that the tension fluctuation in the yarn was transmitted beyond the godet roller of the present invention when the yarn was delivered on the yarn threading zone of the godet roller.

To transmit the tension fluctuation beyond the second godet roller without causing entanglement of the yarn around the second roller, when the tension in the yarn between the first and second godet rollers is almost constant, it is necessary that the first critical tension in the yarn downstream of the second godet roller, below which tension the yarn is caused to entangle around the second godet roller, is smaller than the second critical tension in the yarn downstream of the second godet roller, below which tension the yarn is caused to slip in a delivering direction on the godet roller. According to the observation of the entangling phenomenon, the inventors of the present invention confirmed that when the tension in the yarn between the first and second godet rollers was about 25 g for a polyester yarn of 225 denier/36 filaments, the conventional godet roller with a mirror finished surface had a first critical tension between 5 g and 6 g; on the other hand, the godet roller of the present invention having a diameter of 150 mm and 90 narrow grooves as illustrated in FIG. 5 had a first critical tension between 2 g and 3 g. Based on the measured friction coefficients, the inventors of the present invention estimated that the conventional godet roller has a second critical tension of about zero grams and that the godet roller of the present invention has a second tension of about 5. g. As a result, in a conventional apparatus wherein the conventional godet roller is utilized, when the tension in the yarn downstream of the second godet roller is lowered below 5 or 6 g because of the threading of the yarn on the bobbin, the yarn entangles around the godet roller. On the other hand, in an apparatus wherein the godet roller of the present invention is utilized, when the tension in the yarn downstream of the second godet roller is lowered to about 5 g, the yarn slips on the surface of the godet roller and the yarn does not entangle around the second godet roller.

EXAMPLE

Polyester yarns spun from spinnerets and partially orientated are delivered at a speed of 3500 m/min and wound on bobbins made of paper and having grooves for catching the yarns by means of winders of type SW4SLD manufactured by Barmag Bermer AG, German. The yarns are threaded on 5000 bobbins by means of suction guns of type SD-33ON manufactured by Teijin Seiki Ltd. The result is described in Table 1.

TABLE 1

| | Conventional Apparatus | Apparatus of the present invention |
|---|---|---|
| Efficiency for taking up yarn by suction gun | 94% | 99.6% |
| Efficiency for threading yarn on bobbin | 95% | 99.7% |

As apparent from the results described in the Example, the present invention can remarkably increase the threading efficiency, i.e., efficiency for taking up yarn by suction gun and efficiency for threading yarn on bobbin. Due to the increase of the threading efficiency, the present invention can accomplish an additional advantage. In a usual friction winder, the friction roller 27 has one or more step portions 27*a* as illustrated in FIG. 8. Just after a new bobbin 25 is inserted onto the bobbin holder 23, the bobbin 25 is frictionally engaged with the outermost portions 27*b* of the friction roller 27, and after a certain amount of the yarn is wound on the bobbin 25, the bobbin 25 is frictionally engaged with the step portions 27*a*. Because the diameter of the outermost portions 27*b* is larger than that of the stepped portions 27*a*, the new bobbin 25 is rotated at a peripheral speed higher than the normal peripheral speed just after the yarn is threaded on the bobbin 25 so that the tension in the yarn between the godet roller 11 (FIGS. 3 and 4) and the bobbin 25 is increased and so that the entanglement of the yarn around the godet roller is prevented. In an apparatus wherein the yarn delivered from the godet roller to the bobbin wraps around the friction roller at a very small angle, for example less than 40 deg, the slack in the yarn produced by the threading operation is easily transmitted in the yarn toward the godet roller, and in general, the amount of the radial step between the outermost portions and the step portions is large. If a large step is formed on the friction roller, the quality of the synthetic yarn which is spun from a spinneret and which is partially orientated and which is wound at the innermost portion of the package may be inferior due to the difference in the winding speed. According to the present invention, threading efficiency, i.e., efficiency for taking up yarn by suction gun and efficiency for threading yarn on a bobbin, is considerably increased, and as a result, the amount of the radial step can be smaller than that utilized in a conventional apparatus. Accordingly, the quality of the yarn, especially the eveness of the dyeability of the yarn located at the innermost portion of the package, can be increased according to the present invention by decreasing the amount of the radial step of the friction roller.

It should be noted that the yarn threading zone in the godet roller utilized in the present invention permits the yarn to slip in a first direction along which the yarn is delivered, but does not permit the yarn to substantially slip in a second direction perpendicular to the first direction. In other words, the yarn and the filaments constituting the yarn are securely held in a second direction, and as a result, the fluctuation of the filaments and the yarn does not occur. Accordingly, the quality of the yarn and stability of the winding operation are increased. If two or more yarns are simultaneously taken up, the admixing of the adjacent filaments does not take place because the passage of the filaments is securely held. In addition, the godet roller having many axial grooves is more durable against abrasion than the godet roller having a satin finished surface.

Because the yarn is surely threaded on a bobbin according to the present invention, even when the yarn speed is low, in other words the tension in the yarn between the winding apparatus and the godet roller located just upstream of the winding apparatus is low, the yarn does not fail to thread on a bobbin. However, if the yarn running at low speed is wound on a bobbin, the obtained yarn is inferior in its quality because its denier is too large. On the other hand, it should be noted that in a conventional apparatus, if the tension in the yarn is low, the yarn entangles around the godet roller, and the admixing of the yarn with a large denier does not occur.

To obviate such admixing of the inferior yarn, in the present invention, it is preferable that the threading operation of the yarn on a bobbin is commenced after the empty new bobbin is sped up to a predetermined speed range and the indicator lamp 63 is lit, as illustrated in FIGS. 3 and 4.

In the embodiment illustrated in FIGS. 3 and 4, the rotation of the bobbin holder 23 is directly detected in the winding apparatus 15; however, the rotational speed of the bobbin holder may be detected by means of a stroboscope, and the condition may be acoustically indicated by means of a buzzer instead of the indicating lamp illustrated in FIGS. 3 and 4.

Figure 9:
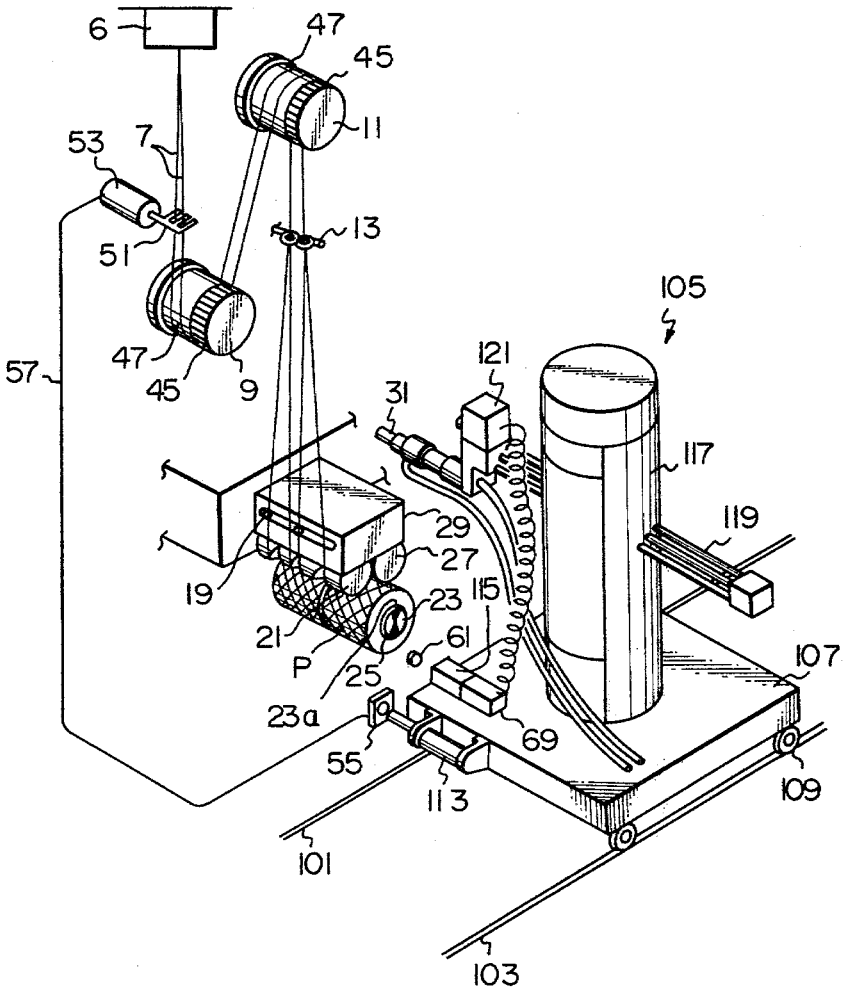
FIG. 9 is a perspective view of another embodiment of the present invention.

Another embodiment of the present invention will now be explained with reference to FIG. 9. In FIG. 9, the spinning and winding apparatus is substantially the same as that illustrated in FIGS. 3 and 4 except that the mechanical valve 55 is disposed at the lower portion of the machine frame, the indicating lamp 61 for indicating that the amount of the package P wound on the bobbin 25 has reached a predetermined amount is disposed at the lower portion of the machine frame; and instead of the indicating lamp 63 and the corresponding parts, a pattern 23*a* is formed on the side of the bobbin holder 23.

In front of the machine frame, a pair of parallel rails 101 and 103 are disposed on the floor. On the rails 101 and 103, an automatic doffing apparatus (not shown) and an automatic threading apparatus 105 are movable. The automatic threading apparatus 105 comprises a base 107 which has a number of wheels 109. The base 107 is provided with a pneumatic cylinder 113 for actuating the mechanical valve 55, a receiver 115 for receiving signals emitted from the lamp 61 upon the completion of the package P and a vertical post 117 along which an arm 119 is vertically movable. The front of the arm 119 has a suction gun 31 and a photoelectric device 121 which is provided with an emitter for emitting a light toward the pattern 23*a* and a receiver for receiving the light reflected from the pattern 23*a* formed on the bobbin holder 23.

When the amount of the package P reaches a predetermined amount, the automatic threading apparatus is positioned in front of the machine frame and sucks the yarns 7 at just below the yarn guide 13 by means of the suction gun 31 after the comb guide 51 is advanced by pushing the mechanical valve 55 by the pneumatic cylinder 113 and after the yarns 7 are displaced to the yarn threading zone 45. Then the full bobbins with packages P are doffed onto the doffing apparatus (not shown) and empty bobbins 25 are inserted onto the bobbin holder 23 from the doffing apparatus. After the photoelectric device 121 detects that the speed of the bobbin holder reaches a predetermined speed, the suction gun 31 is moved three dimensionally and the yarns 7 are threaded on bobbins 25. The comb guide 51 is retracted and the yarns 7 are returned to the normal yarn delivering zone 47 on the godet rollers 9 and 11.

According to the present invention, the yarns can be threaded at a high efficiency. Accordingly, the reliability of the automatic spinning and winding operation can be achieved. Generally, in an automatic threading apparatus, it is very difficult to repeat the threading operation if it once fails to thread a yarn on a bobbin. This is because in such case the thread often becomes entangled around one of the godet rollers and the automatic threading apparatus does not have a mechanism for removing the entanglement of the yarn from the godet roller. Since the present invention is reliable in its threading operation, it is preferable for automatic spinning and winding of the yarn.

An apparatus which utilizes a turret type automatic bobbin changing winding apparatus and in which the present invention is applied will now be explained with reference to FIGS. 10 and 11. The apparatus illustrated in FIGS. 10 and 11 is substantially the same as that illustrated in FIGS. 3 and 4 except for the winding apparatus 151, and the same parts as those in FIGS. 3 and 4 are designated by the same reference numerals as those in FIGS. 3 and 4 and their detailed explanation is omitted here.

Figure 10:
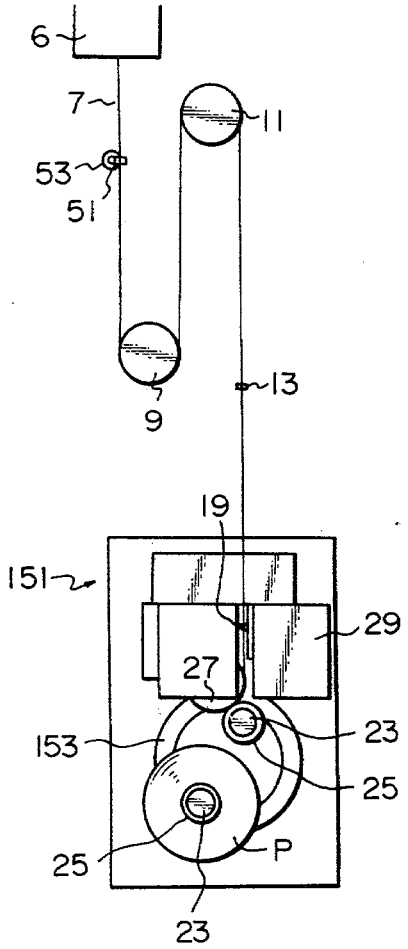
FIG. 10 is an elevational view of a further embodiment of the present invention.
Figure 11:
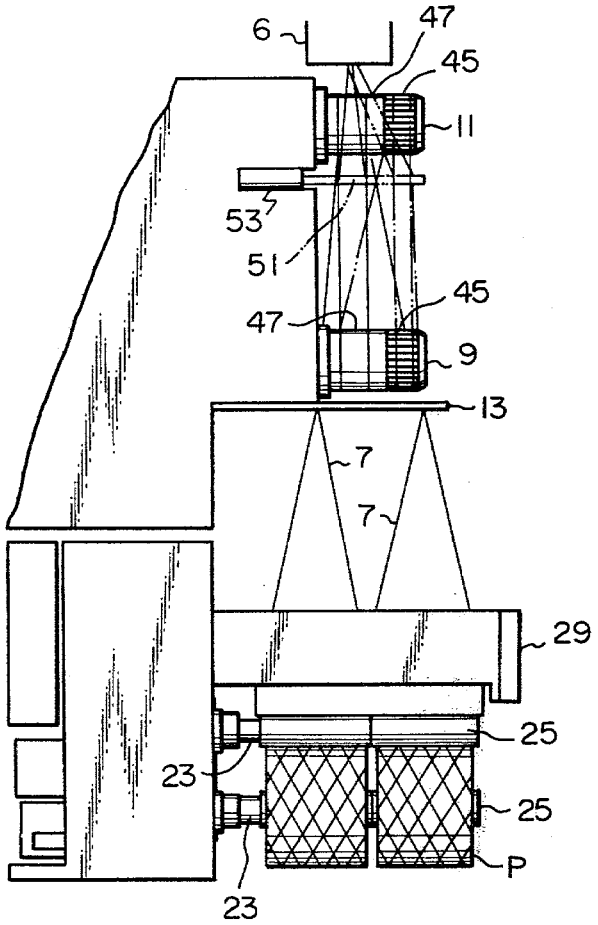
FIG. 11 is a side view of FIG. 10.

The winding apparatus illustrated in FIGS. 10 and 11 is a type disclosed in U.S. Pat. No. 4,033,519; however, other turret type automatic winding apparatuses are also applicable. The winding apparatus 151 is provided with: a turnable turrent 153 having a pair of rotatable bobbin holders 23 projected therefrom; and a carrier 29 including a friction roller for selectively frictionally engaging the bobbins 25 held on the bobbin holders 23 and traverse guides 19 for traversing the yarns.

In such an automatic bobbin changing apparatus, the yarns are automatically threaded on bobbins while the full bobbins are exchanged for empty bobbins by turning the turret, and therefore, any yarn take up means, such as a suction gun, is not used in the apparatus.

When the full bobbins are completed, the pneumatic actuator 53 is advanced by a signal emitted from the winding apparatus 151, and the yarns 7 are displaced from the normal yarn delivering zone 47 to the yarn threading zone 45. Then the turret 153 turns, and the full bobbins are replaced by the empty bobbins, and simultaneously the yarns are threaded on the empty bobbins without causing entanglement of the yarns around the godet rollers 9 and 11 because slack in the yarn runs back beyond the godet rollers 9 and 11. Naturally, the turret 153 turns after the empty bobbin reaches a predetermined speed. The comb guide 51 is retracted to its original position, and the yarns 7 are returned to the normal yarn delivering zone 47 of the godet roller 9 and 11.

According to the present invention, just before the yarn is threaded on a yarn winding apparatus, it is moved to a yarn threading zone of a godet roller, and therefore, slack in the yarn which has caused a serious problem concerning the entanglement of the yarn around the godet roller is not substantially produced. More specifically, since the yarn is delivered on the yarn threading zone of a godet roller, the lowering of the tension in the yarn which has produced slack of the yarn is transmitted beyond the godet roller, and the yarn does not entangle around the godet roller. As a result, efficiency for threading a yarn on a bobbin inserted on a bobbin holder is increased to almost 100%.

What we claim is:

1. In a process wherein a bobbin rotatably supported on and rotated by a winding apparatus may receive a yarn delivered to the bobbin via a godet roller, a method for threading the yarn on the bobbin, comprising the steps of:

providing a godet roller having a circumferential yarn delivery zone and an adjacent circumferential yarn threading zone axially spaced from said yarn delivery zone, disposed so that said yarn may be delivered to and taken up by said bobbin via said yarn delivery zone of said godet roller, said yarn delivery zone having a surface for substantially preventing circumferential and axial slippage of said yarn thereon;

thereafter providing relative axial movement between said yarn and said godet roller, so that said yarn engages only the yarn threading zone of the godet roller, said yarn threading zone presenting (i) a relatively low friction surface to permit slippage of said yarn in the circumferential direction of the godet roller when the yarn tension exceeds a given value, and (ii) a relatively high friction surface to resist slippage of said yarn in the axial direction of the godet roller;

engaging the free end of the yarn traversing the yarn threading zone of the godet roller with said bobbin, so that said free end is caught thereby; and subsequently providing relative axial movement between said yarn and said godet roller, so that said yarn again engages only the yarn delivery zone of the roller, whereby any change in tension in said yarn while said yarn is threaded on said bobbin can be distributed in yarn located upstream and downstream of said godet roller and entanglement of said yarn around said godet roller is prevented.

2. A method according to claim 1, wherein said yarn is held by a yarn take up means located downstream of said godet roller.

3. A method according to claim 2, which further comprises:

displacing said yarn on said godet roller from said normal yarn delivering zone to said yarn threading zone; and taking up said yarn, by said yarn take up means, wherein said displacing and taking up steps take place prior to said delivering, engaging and returning steps, whereby the yarn is continuously delivered.

4. A method according to claim 1, wherein said yarn engaging step takes place after the peripheral speed of said rotating bobbin reaches a predetermined speed range.

5. A method according to claim 1, wherein said normal yarn delivering zone of said godet roller is formed by a substantially mirror finished surface, and said yarn threading zone of said godet roller is provided with a plurality of fine grooves extending axially of said godet roller.

6. A method according to claim 2, wherein said bobbin is provided with a yarn catching groove, and the yarn held by said yarn take up means is caught by said yarn catching groove, whereby the yarn between said yarn catching groove and said yarn take up means is cut when the tension in said yarn is increased by the rotation of said yarn.

7. The method according to claim 1, comprising the additional steps carried out upstream of said godet roller:

spinning from a spinneret a plurality of synthetic filaments which constitute said yarn; and partially orienting said yarn between said spinneret and said godet roller.

8. Apparatus for threading a yarn on a bobbin, which apparatus comprises:

a godet roller for delivering said yarn to said bobbin, which roller is provided with a substantially mirror finished circumferential surface which serves as a yarn delivery zone, and an axially grooved circumferential surface formed axially adjacent to said mirror finished surface and having a plurality of fine grooves extending axially of said godet roller and serving as a yarn threading zone, so that in said yarn threading zone said yarn is permitted to slip in a first direction along which said yarn is delivered when the tension in said yarn exceeds a predetermined tension, while said yarn does not substantially slip in the axial direction of said godet roller, and in said yarn delivery zone said yarn does not substantially slip in said first and axial directions;

a yarn displacing guide which is disposed upstream of said godet roller for movement parallel to the axis of said godet roller for displacing said yarn on said godet roller to lie on only said yarn delivery zone or on only said yarn threading zone; and a winder disposed downstream of said godet roller and having a rotatable bobbin holder on which said bobbin is inserted.

9. An apparatus according to claim 8, wherein said winder further comprises a friction roller for frictionally driving the peripheral surface of said bobbin inserted on said bobbin holder.

10. An apparatus according to claim 9, wherein said winder is so constructed that said yarn delivered from said godet roller to said bobbin does not substantially wrap around said friction roller at an angle more than a predetermined angle.

11. An apparatus according to claim 9, wherein said winder is a turret type automatic bobbin changing winder and further comprises another bobbin holder.

12. An apparatus according to claim 8, wherein said apparatus is disposed downstream of a spinneret for spinning a synthetic yarn.

13. An apparatus according to claim 12, which further comprises a means for detecting the peripheral speed of said bobbin inserted on said bobbin holder.

* * * * *